US005901511A

United States Patent [19]

Yoshida

[11] Patent Number: 5,901,511

[45] Date of Patent: May 11, 1999

[54] MULTI-PURPOSE DOORJAMB ASSEMBLY

[75] Inventor: Takeshi Yoshida, Portland, Oreg.

[73] Assignee: Tactix, Inc., Portland, Oreg.

[21] Appl. No.: 08/657,036

[22] Filed: May 30, 1996

[51] Int. Cl.[6] ..... E06B 1/10

[52] U.S. Cl. ..... 52/212; 52/210; 52/211; 52/217; 49/504; 49/505

[58] Field of Search ..... 52/207, 215, 210–212, 52/217, 717.01, 730.1, 730.7, 731.7, 731.8, 656.4; 49/504, 505, 382; 160/199, 206

[56] References Cited

U.S. PATENT DOCUMENTS

| | | | |
|---|---|---|---|
| 1,496,525 | 6/1924 | Coco . | |
| 2,595,506 | 5/1952 | Backman | 189/46 |
| 2,736,930 | 3/1956 | Longley | 20/11 |
| 2,872,711 | 2/1959 | Killebrew | 52/212 |
| 3,300,897 | 1/1967 | Wikkerink | 49/137 |
| 3,685,226 | 8/1972 | Richter | 52/217 |
| 3,698,883 | 10/1972 | DiFazio | 49/453 X |
| 3,810,330 | 5/1974 | Daggy | 49/425 X |
| 3,946,790 | 3/1976 | Besse | 160/206 |
| 4,014,146 | 3/1977 | DiMascio | 52/215 X |
| 4,068,433 | 1/1978 | Glover | 52/207 |
| 4,109,346 | 8/1978 | Strozier | 160/206 X |
| 4,589,229 | 5/1986 | Warren | 49/505 |
| 5,065,807 | 11/1991 | Maeda et al. | 160/206 X |
| 5,085,262 | 2/1992 | Tutikawa | 160/206 X |
| 5,115,597 | 5/1992 | Tillery | 40/504 |
| 5,321,911 | 6/1994 | Dickinson | 49/404 |
| 5,347,780 | 9/1994 | Richards | 40/504 X |
| 5,365,708 | 11/1994 | Winston | 52/212 |
| 5,437,130 | 8/1995 | Raynak | 52/210 |
| 5,515,658 | 5/1996 | Jorde | 52/215 |
| 5,515,901 | 5/1996 | Hall | 160/206 |
| 5,566,509 | 10/1996 | Long | 52/210 X |

FOREIGN PATENT DOCUMENTS

| | | | |
|---|---|---|---|
| 715322 | 8/1965 | Canada | 108/68 |
| 1177697 | 11/1984 | Canada | 108/66 |

*Primary Examiner*—Beth A. Aubrey
*Attorney, Agent, or Firm*—Chernoff, Vilhauer, McClung & Stenzel, LLP

[57] ABSTRACT

A multi-purpose adjustable doorjamb assembly includes at least three elongate members: a first side member, a second side member, and a cross member. Each elongate member has an inside longitudinal face opposite an outside longitudinal face. Each face has a longitudinal notch defined therein. The side members are attached to either ends of the cross member to form an open-sided rectangle. The assembly may also include at least three door stops. The jamb assembly may be used to accommodate swinging doors, bi-fold doors, or sliding doors. Finally, each elongate member may include a front longitudinal edge and a back longitudinal edge. Each edge has a longitudinal trim notch. The assembly further includes L-shaped trim members each having a mating leg for adjustably mating with the trim notch and a decorative leg. By using a trim member on both sides of an elongate member both narrow and wide walls can be accommodated.

22 Claims, 5 Drawing Sheets

MULTI-PURPOSE DOORJAMB ASSEMBLY

BACKGROUND OF THE INVENTION

The present invention relates to a multipurpose doorjamb assembly for use with swinging, bi-fold, or sliding doors.

A conventional method used in constructing a doorway in a wall uses a doorjamb assembly (jamb) consisting of left and right side members, a top or cross member (also called a header or lintel), and an optional bottom member. Each member generally consists of at least two pieces that may be adjustably interconnected and then held together so that the cumulative width of the connected pieces is equal to the width of the wall. Examples of this type of jamb assembly are shown in U.S. Pat. No. 4,589,229 to Warren, U.S. Pat. No. 2,736,930 to J. P. Longley, and U.S. Pat. No. 5,365,708 to Winston. One problem with this two-piece construction is that the members are substantially weaker when they are connected to form a maximum width than when they are connected to form their minimum width. Also, the weakness is generally at the point of interconnection that, when centrally located, generally supports the weight of the door. Other problems associated with using multiple pieces is that it multiplies proportionally the necessary work, expense, and complications with the number of pieces cut.

Traditional jamb assemblies often include a door stop that is incorporated in one of the pieces (as shown in the Warren and Longley patents). In these assemblies, each member must be positioned so that the face with the door stop faces into the doorway (and the opposite face is against the wall). This predetermines the orientation of the member and limits its use. Further, the inclusion of a door stop on one of the pieces tends to complicate the shape of the piece and therefore increases production costs.

The Winston patent discloses a jamb assembly that includes two-piece elongate members and a separate door stop. The two pieces are essentially identical and include a longitudinal groove or notch. The door stop has an off-center tongue that mates with one of the grooves. The two pieces of the elongate members are adjustably interconnected by expanding or contracting a gap between the two pieces and then covering the gap with the door stop. To allow for the maximum adjustability, the tongue must be to one side of the door stop. This construction, like the two-piece constructions mentioned above, has problems caused by the two-piece construction of the elongate members. Also, since more pieces are needed, production costs are increased.

Traditional trim is substantially flat on one side and decorative on the other side. The flat side adjoins with the member and the wall to hide any gap therebetween. Examples of this trim may be found in the J. P. Longley patent and the Winston patent.

What is needed then is a jamb assembly that includes elongate members that are strong, simple to make, and economical to produce. Further, the elongate members should be adaptable to accommodate walls of different widths.

SUMMARY OF THE INVENTION

A multi-purpose jamb assembly of the present invention is designed for installing a door in a rough cut wall opening. The assembly generally includes at least three elongate members: a first side member, a second side member, and a cross member. Each elongate member has an inside longitudinal face opposite an outside longitudinal face, a front longitudinal edge opposite a back longitudinal edge, and a first end opposite a second end. Each longitudinal face has a longitudinal notch defined therein that preferably extends substantially from the first end to the second end of the elongate member. To construct the jamb, the first end of the first side member is attached to the first end of the cross member and the first end of the second side member is attached to the second end of the cross member. Taken together, this construction forms an open-sided rectangle wherein the inside faces of the first side member, second side member, and cross member face inwardly.

At least three door stops that are designed to mate with the notches are also included in the assembly. The door stops are inserted into corresponding notches in the inside faces of the elongate members.

The jamb assembly of the present invention may be adapted to accommodate swinging doors, bi-fold doors, or sliding doors. For a swinging door, the door is hinged to a side member. For a bi-fold door, a track is included on the inside face of the cross member. A first section of the bi-fold door is pivotally attached to the cross member by a pivot on a top surface of the first section. A second section of the bi-fold door has a glide on a top surface of the second door section that slidably engages the track. For a sliding door, a longitudinally partitioned track is included on the inside face of the cross member; this track is slidably engaged with a glide attached to the top portion of a sliding door.

Finally, a jamb assembly of the present invention may include door trim that is both functional and aesthetically pleasing. To this end, each longitudinal edge of each longitudinal member may include a longitudinal trim notch. For each side of the doorway, at least three L-shaped trim members may be used. Each trim member has a mating leg for mating with the trim notch and a decorative leg. When the mating leg interconnects with the trim notch, the decorative leg provides an attractive finish to the assembly.

The foregoing and other objectives, features, and advantages of the invention will be more readily understood upon consideration of the following detailed description of the invention, taken in conjunction with the accompanying drawings.

DETAILED DESCRIPTION OF PREFERRED EMBODIMENTS

Figure 7:
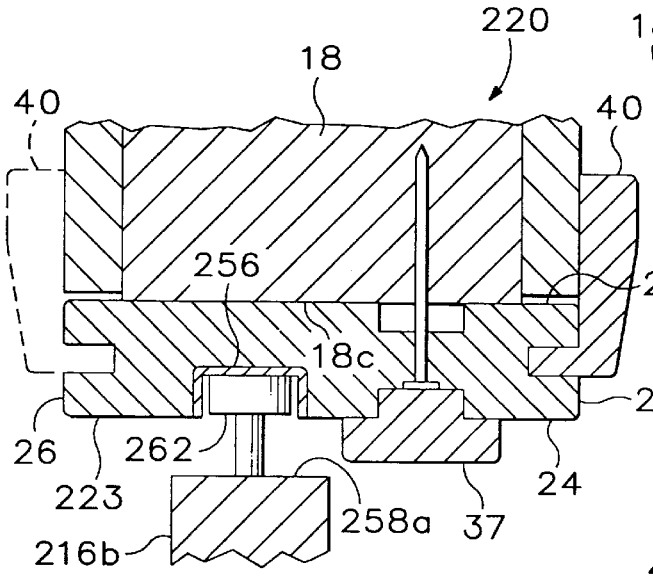
FIG. 7 is a cross section of a cross member of the jamb assembly taken along lines 7—7 in FIGS. 5 and 6.
Figure 8:
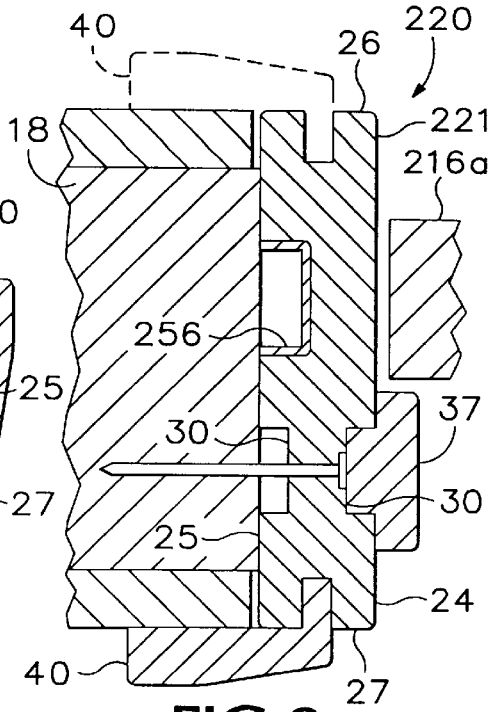
FIG. 8 is a cross section of a side member of the jamb assembly taken along lines 8—8 in FIGS. 5 and 6.
Figure 9:
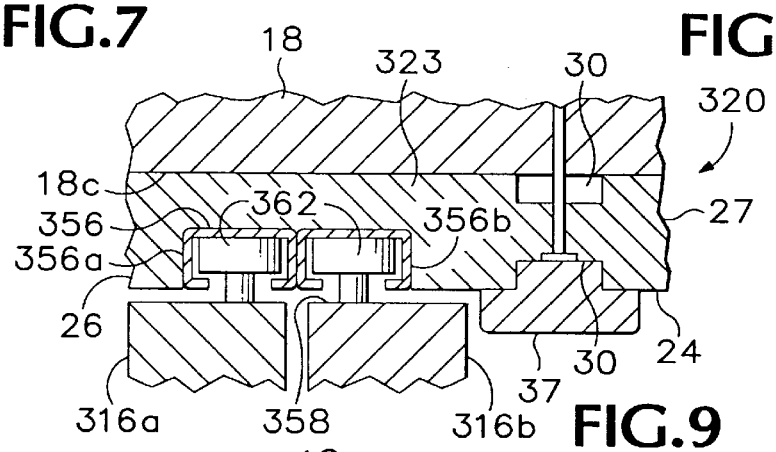
FIG. 9 is a cross section of a cross member of a jamb assembly for use with a sliding door.

The multi-purpose jamb assembly of the present invention is used for installing a door in a rough cut opening of a wall 18. The jamb assembly of the present invention has three primary embodiments. FIGS. 1–4 show the first embodiment, the swinging jamb 120, that may be used in connection with a swinging door 116. FIGS. 5–8 show the second embodiment, the bi-fold jamb 220, that may be used in connection with one or more bi-fold doors 216 that each include a first section 216*a* and a second section 216*b* connected by a hinge 217. FIG. 9 shows a cross section of the third embodiment, the sliding jamb 320, that may be used in connection with one or more sliding doors 316*a*, 316*b*.

Each jamb 120, 220, 320 includes at least three elongate members. The swinging jamb's 120 elongate members are a first side member 121, a second side member 122, and a cross member 123. The bi-fold jamb's 220 elongate members are a first side member 221, a second side member 222, and a cross member 223. The sliding jamb's 320 elongate members are a first side member (not shown), a second side member 322, and a cross member 323.

Each elongate member has an inside longitudinal face 24 and an outside longitudinal face 25. The inside longitudinal face 24 faces inwardly toward the inside of the doorway. The outside longitudinal face 25 faces outwardly toward the wall 18. The inside longitudinal face 24 is on the opposite side from the outside longitudinal face 25.

Each elongate member also has a front longitudinal edge 26 and a back longitudinal edge 27. The front longitudinal edge 26 is the edge closest to the portion of the elongate member designed to engage a door. For example, for the first side member 121 of a swinging jamb 120, the front longitudinal edge 26 would be the edge on the side of first elongate member 121 between the hinge mortises 146 on the inside and outside faces 24 and 25. Also, for cross members 223, 323 of the bi-fold and sliding jambs 220, 320, the front longitudinal edge 26 would be the edge on the side of the cross members 223, 323 closest to the track 256, 356 that engages the door 216, 316*a*, 316*b*. The back longitudinal edge 27 is on the opposite side of the elongate member from the front longitudinal edge 26.

Figure 1:
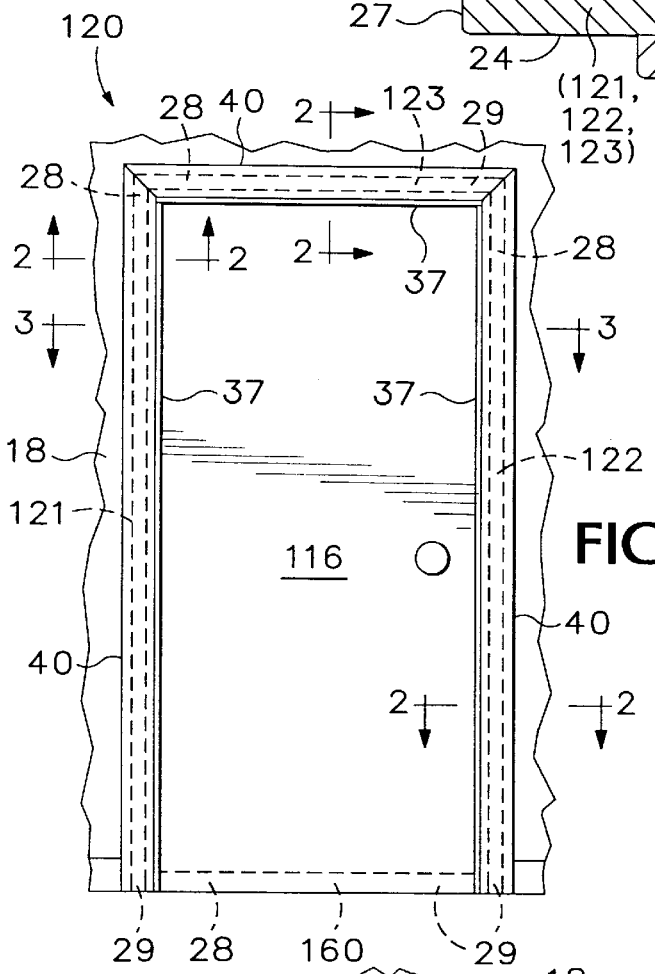
FIG. 1 is a first embodiment of a jamb assembly of the present invention and a swinging door.
Figures 5, 6:
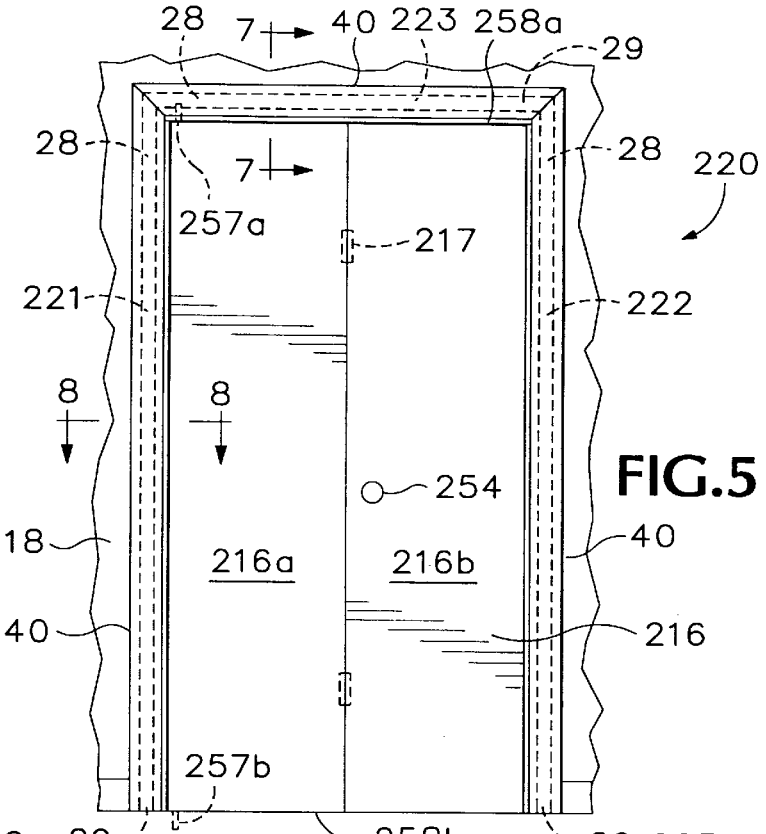
FIG. 5 is a second embodiment of a jamb assembly of the present invention and a bi-fold door.
FIG. 6 is a second embodiment of a jamb assembly of the present invention and two bi-fold doors.

Finally, as shown in FIGS. 1 and 5, each elongate member has a first end 28 and a second end 29. The first end 28 is on the opposite side from the second end 29. It should be noted that the first and second ends 28 and 29 refer generally to the top and bottom end portions, respectively, of the side members 121, 122, 221, 222, 322 and to the left and right end portions, respectively, of the cross members 123, 223, 323.

It should also be noted that because the members are generally symmetrical with some exceptions (discussed below), the designation of the faces, edges, and ends generally pertains to the position of the member as installed. For example, before installation, either face of an elongate member can be adjacent the wall 18, but the face that is adjacent upon installation will be referred to as the outside face 25.

Each face 24 and 25 of each elongate member has a longitudinal groove or notch 30 extending substantially from the first end 28 to the second end 29 of the elongate member. As mentioned above, the inside longitudinal face 24 is on the opposite side of the elongate member as the outside longitudinal face 25. Preferably, notches 30 are aligned so that they are "back to back" on opposite faces 24, 25 of the elongate member.

Each elongate member is preferably symmetrical about a longitudinal plane bisecting the inside face 24 and the outside face 25. In most embodiments, unless not specifically stated otherwise, any modifications made to the basic body of the elongate members are preferably done to both faces 24 and 25 so that such members remain symmetrical. An advantage of elongate members being symmetrical is that if one face is marred, the opposite face may be used as the inside face 24 and the marred face may be used as the outside face 25 since it will not show after installation.

Figure 3:
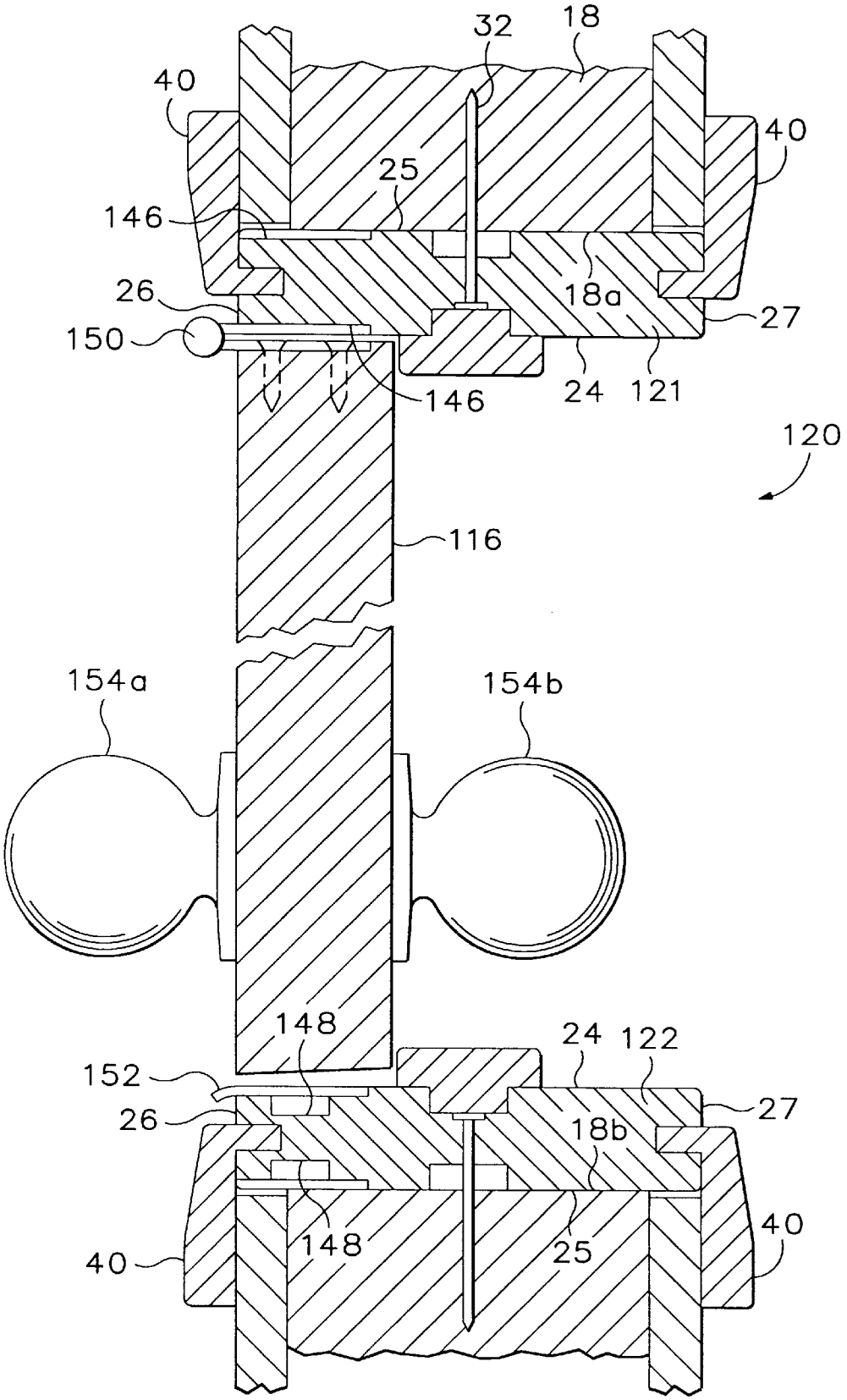
FIG. 3 is a cross section of the jamb assembly and swinging door taken along lines 3—3 in FIG. 1.
Figure 4:
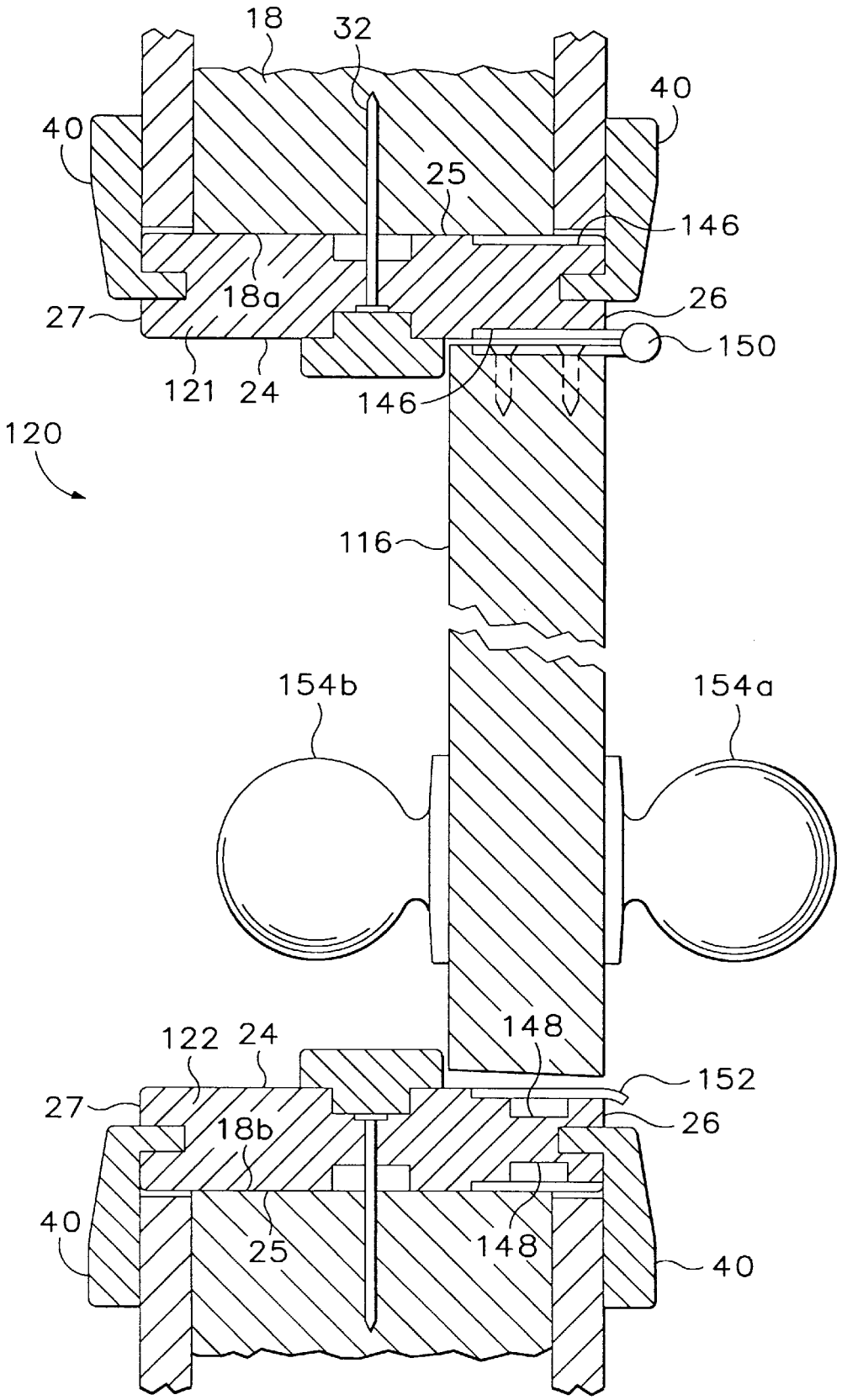
FIG. 4 is a cross section of the jamb assembly in a reversed position.

Turning briefly to the rough cut wall opening for accommodating a door 116, 216, 316*a*, 316*b*, FIGS. 3 and 4 show a wall opening defined between a first wall opening side 18*a* and a second wall opening side 18*b*. The third wall opening side, a cross wall opening side 18*c*, shown in FIGS. 7 and 9, is the side of the wall adjacent the outside face 25 of a cross member 123, 223, 323.

To install a door into a rough cut wall opening in a wall 18, the elongate members are set into the wall 18 so that the first end 28 of a first side member 121, 221 is attached to the first end 28 of the cross member 123, 223, 323 and the first end 28 of the second side member 122, 222, 322 is attached to the second end 29 of the cross member 123, 223, 323. Taken together, the first side member 121, 221, the second side member 122, 222, 322, and the cross member 123, 223, 323 form an open-sided rectangle. As installed, the inside face 24 of each elongate member faces inwardly into the inside of the rectangle. Further, the outside face 25 of the first side member 121, 221 is adjacent the first wall opening side 18*a*, the outside face 25 of the second side member 122, 222, 322 is adjacent the second wall opening side 18*b*, and the outside face 25 of the cross member 123, 223, 323 is adjacent the cross wall opening side 18*c*.

As mentioned above, elongate members are generally symmetrical and when this is so the inside face 24 and outside face 25 are identical. Accordingly, which of the two faces is designated as the inside face 24 is determined by which face faces inwardly. Similarly, the face facing the wall 18 is designated as the outside face 25. In certain embodiments discussed below (particularly those associated with the bi-fold jamb 220 and sliding jamb 320), the faces are not symmetrical and, therefore, which face is the inside face 24 is determined by the particular orientation of the elongate member.

In a preferred embodiment the elongate members are secured to their respective wall opening side (18*a*–18*c*) using one or more fastening means 32 such as a nail, staple, adhesive, or screw. More specifically, a fastening means 32 preferably extends through the longitudinal notch 30 in the inside face 24, of the elongate member and into the corresponding wall opening side (18*a*–18*c*).

Figure 10A:
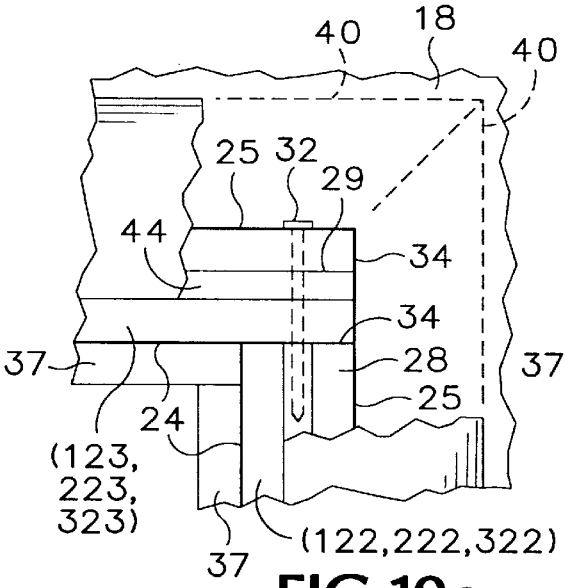
FIGS. 10*a* and 10*b* are enlarged cutaway views of corner constructions of the jamb assembly.
Figure 10B:
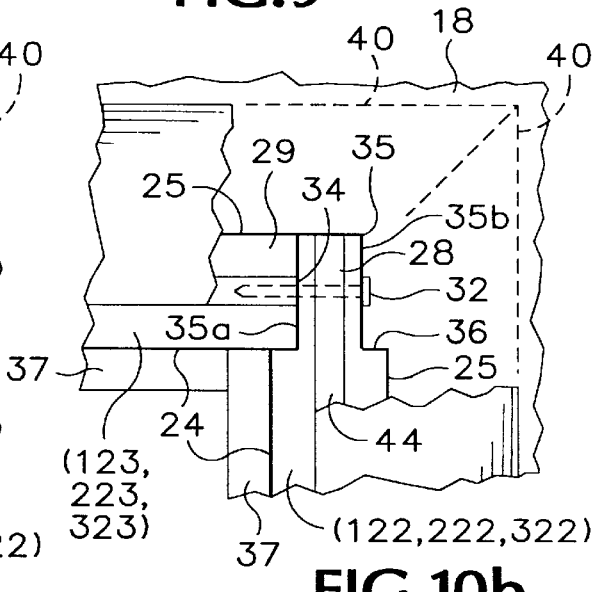

FIGS. 10*a* and 10*b* show exemplary methods of interconnecting the elongate members. More specifically, FIG. 10*a* shows a cross member 123, 223, 323 with a flat end surface 34 at its second end 29 connected to a second side member 122, 222, 322 with a flat end surface 34 at its first end 28. Fastening means 32 may be driven downward through the outside face 25 near the second end 29 of the cross member 123, 223, 323 and into the flat end surface 34 of the second side member 122, 222, 322. FIG. 10*b* shows a cross member 123, 223, 323 (that in practice would be slightly shorter than the cross member 123, 223, 323 in FIG. 10*a*) with a flat end surface 34 connected to a second side member 122, 222, 322 with a central protrusion 35 and shoulders 26 on either side of the central protrusion 35. The central protrusion 35 has an inside protrusion face 35*a* and an outside protrusion face 35*b*. In this embodiment, the second end 29 of the cross member 123, 223, 323 rests on the shoulder 36 of the second side member 122, 222, 322 and the fastening means 32 is driven sideways through the central protrusion 35 of the second side member 122, 222, 322 and into the flat end surface 34 of the cross member 123, 223, 323.

Each jamb 120, 220, 320 also includes at least three door stops 37. Each door stop 37 has a cap 37*a* and a protrusion 37*b* for mating with the longitudinal notch 30 of either of the faces 24, 25. When members have been attached to the wall 18, door stops 37 may be set into notch 30 of the inside face 24 of each elongate member by inserting protrusion 37*b* into notch 30. Door stops 37 may also be inserted prior to the installation of the jamb 120, 220, 320. Door stops 37 may be secured within notch 30 by adhesive or other fastening means.

To give the jamb assembly a finished appearance, trim 40 may be attached to either or both sides of the jamb. Trim 40, in addition to being aesthetically pleasing, helps secure members to the wall 18. It also covers the gap between the members and the wall 18. Generally trim 40 would be used on both sides of the jamb 120, 220, 320 (using three trim members on each side of the jamb). However, if the doorway is an entrance to a closet or otherwise would not be seen from a second side, trim 40 could be used on one side only (FIGS. 7 and 8).

Figure 2A:
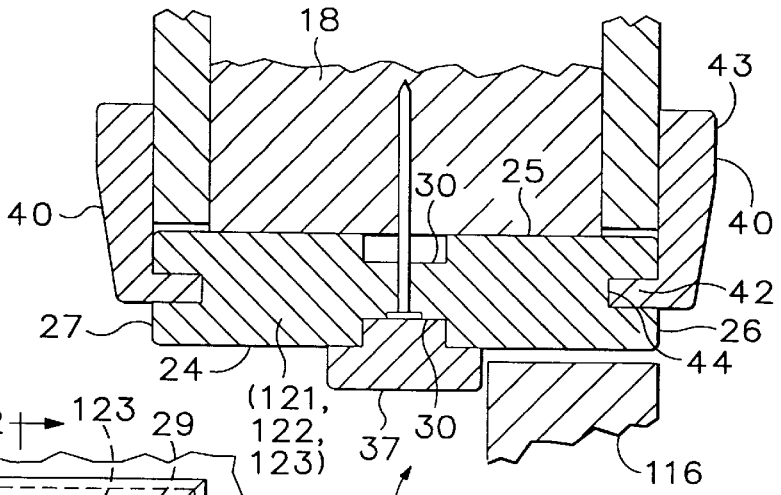
FIG. 2*a* is a cross section of the jamb assembly taken along lines 2—2 in FIG. 1.
Figure 2B:
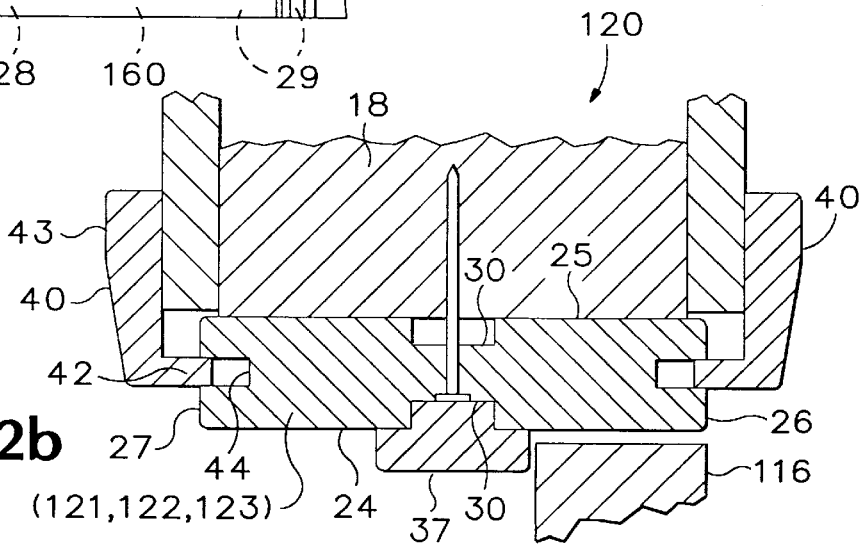
FIG. 2*b* is a cross section of the jamb assembly taken along lines 2—2 in FIG. 1 adapted for use with a thick wall.

Preferably, as shown in FIGS. 2*a* and 2*b*, trim 40 is L-shaped with a longitudinal mating leg 42 for mating with a longitudinal trim notch 44 on at least one longitudinal edge (26 or 27) of elongate members. Trim 40 also has a decorative longitudinal leg 43 that preferably has a finished exterior surface. Although the length of mating leg 42 may be modified to accommodate walls of different widths, L-shaped trim 40 is specifically designed to allow some adjustability without modifying the length of mating leg 42. More specifically, FIG. 2*a* shows a narrow wall 18 in which the mating leg 42 on either side of the elongate member 121, 122, 123 is flush with trim notch 44. On the other hand, FIG. 2*b* shows a wider wall 18 wherein the mating leg 42 on either side of the elongate member 121, 122, 123 is pulled out of trim notch 44 so that there is a gap between the tip of mating leg 42 and the bottom of trim notch 44. It should be noted that the appearance of the jamb 120, 220, 320 is not significantly altered so long as at least the tip of mating leg 42 remains at least partially engaged with trim notch 44.

Trim 40 is reversible in that it may be mated with the trim notch 44 on either longitudinal edge 26, 27. Further, the decorative leg 43 may extend beyond either face 24, 25 (which allows for trim member to be used regardless of the elongate member's position). Trim members that have two squared ends (not shown) are completely reversible and can be interconnected by known methods. Trim members that have two mitered ends (that are beveled at 45° angles), such as the trim members associated with cross members 123, 223, 323, are completely reversible. Side trim members that have a squared bottom end and a mitered top end (FIGS. 1 and 5) may mate with the trim notch 44 on the longitudinal edge 26, 27 of one side member 121, 122, 221, 222 or it may mate with the trim notch 44 on the opposite longitudinal edge of the opposite side member. Finally, the trim members are completely reversible if the trim members may be mitered by the customer for proper installation.

The swinging jamb 120 in FIGS. 1–4 is designed to accommodate a conventional swinging door 116. As mentioned above, the basic body of each elongate member 121, 122, 123 is symmetrical about a longitudinal plane bisecting the inside face 24 and the outside face 25. Further, the cross sections of the different members 121, 122, 123 are substantially the same, as is apparent from the fact that FIGS. 2*a* and 2*b* are alternate cross sections taken along lines 2—2 which intersect all three members 121, 122, 123. Modifications to the elongate members 121, 122, 123 (such as the inclusion of mortises 146 and 148) do not affect the length of such elongate members.

As shown in FIGS. 3 and 4, first side member 121 of this swinging jamb 120 embodiment is adapted to be connected to a swinging door 116 using one or more hinges 150. Although hinge 150 could be surface-mounted or attached flush with the inside face 24 of first side member 121, preferably at least one hinge mortise 146 is included on the inside face 24 of the front longitudinal edge 26 of first side member 121. To make first side member 121 optimally adaptable, at least one hinge mortise 146 is also included on the outside face 25 of the front longitudinal edge 26 of first side member 121. If hinge mortises 146 are on both the inside and outside faces 24 and 25, first side member 121 remains symmetrical.

As shown in FIGS. 3 and 4, second side member 122 of this embodiment is adapted to be connected to a door lock (not shown) and, therefore, may include at least one lock mortise 148. Although a door lock may not be required for the particular installation, preferably at least one lock mortise 148 is included on the inside face 24 of the front longitudinal edge 26 of second side member 122, so as to allow for the possibility of including a lock. To make second side member 122 optimally adaptable, at least one lock mortise 148 is also included on the outside face 25 of the front longitudinal edge 26 of second side member 122. If lock mortises 148 are on both the inside and outside faces 24 and 25, second side member 122 remains symmetrical.

Using symmetrical first and second side members 121 and 122 allows for optimal adaptability. For example, FIG. 3 shows a swinging jamb 120 that may be either a right-handed in-swinging door if knob 154*a* is to be used or a left-handed out-swinging door if knob 154*b* is to be used. On the other hand, by reversing the positions of the first and second side members 121 and 122, the embodiment shown in FIG. 4 is obtained. FIG. 4 shows a swinging jamb 120 that may be either a left-handed in-swinging door if knob 154*a* is to be used or a right-handed out-swinging door if knob 154*b* is to be used.

The bi-fold jamb 220 shown in FIGS. 5–8 is designed to accommodate at least one conventional bi-fold door 216. As mentioned above, bi-fold door 216 generally has two sections 216*a* and 216*b* that are attached by at least one hinge 217. Bi-fold jamb 220 includes a cross member 223 (FIG. 7) that includes a U-shaped track 256 that is preferably embedded in the inside face 24. The first door section 216*a* is pivotally attached to cross member 223 by an upper pivot 257*a* on a top surface 258*a* of the first door section 216*a*. Preferably, a lower pivot 257*b* on a bottom surface 258*b* of the first door section 216*a* pivotally engages the floor or a bottom cross member 260. A second door section 216*b* includes a glide 262 on the top surface 258*a* of the second door section 216*b* that is slidably engaged with track 256. As the second door section 216*b* slides through track 256, it also pivots. When knobs 254 are pulled, first door section 216*a* pivots about pivots 257*a* and 257*b* while the second section 216*b* simultaneously slides and pivots through track 256.

As mentioned above, the basic body of each elongate member 221, 222, 223 is symmetrical about a longitudinal plane bisecting the inside face 24 and the outside face 25. In a preferred embodiment, to accommodate track 256, notches 30 may be closer to the back edge 27 than to the front edge 26. Moving notches 30 backward does not affect the symmetry. However, if track 256 is on one face, the cross member 223 is no longer symmetrical; this construction is shown in FIG. 7. It should be noted that if the cross member 223 includes either no track or tracks on both faces 24, 25 it remains symmetrical.

Regarding the first and second side members 221 and 222, they also have notches 30 that are positioned closer to the back edge 27 than to the front edge 26. This positioning allows notches 30 in the side members 221 and 222 to align with notch 30 in the inside face 24 of the cross member 223 and, consequently, door stops 37 in notches 30 are also aligned when they are positioned in notches 30. One or more of the side members 221, 222 may include a track 256 as shown in FIG. 8. If the side members 221 and 222 include a track 256, the side member should be positioned so that track 256 is on the outside face 25 hidden against the wall 18, as shown in FIG. 8, so that it cannot be seen.

The bi-fold jamb 220 shown in FIG. 5 shows a single bi-fold door 216, whereas the bi-fold jamb 220 shown in FIG. 6 shows the bi-fold jamb 220 with a wider cross member 223 that accommodates two bi-fold doors. As mentioned above, the cross member 223 must have a track 256. With this in mind, a commercially economical approach to packaging bi-fold jambs 220 is to only sell single bi-fold door packages that include a first side member 221 with a track 256, a second side member 222 without a track 256, a "short" (equivalent to the width of one bi-fold door 216) cross member 223 with a track 256, a single bi-fold door 216, and other pieces necessary to construct a bi-fold jamb 220 for a single bi-fold door 216. If a double bi-fold door embodiment is desired, two single bi-fold door packages are purchased so that the first side member 221 (that has a length equivalent to the width of two bi-fold doors 216) with track 256 becomes the cross member 223.

FIG. 9 shows a sliding jamb 320 that has a construction similar to the bi-fold jamb 220 with the most significant difference being the track 356. Instead of a single U-shaped track such as track 256, track 356 is a double track comprising two adjacent C-shaped tracks 356*a* and 356*b*. A first sliding door 316*a* would be hung by at least one glide 362 on the top door surface 358 in first track 356*a*. A second sliding door 316*b* would be hung by at least one glide 362 on the top door surface 358 in second track 356*b*. In this embodiment, each door 316*a*, 316*b* could slide from one side of the doorway to the other independently of the other door since each door is in its own track. If more than one door is hung in one of the independent tracks of the double track, the doors therein would be limited as to how far they could slide.

Regarding the sliding jamb 320, it should be noted that a single track 356 could be used if only one sliding door is needed. It should also be noted that the glide 362 may take several forms such as a roller, wheel, or a peg. Finally, if the top door surface 358 of a door 316*a*, 316*b* could directly engage a corresponding track 356*a*, 356*b* without using a glide 362. Preferably, if no glide 362 is used, the bottom of the doors 316*a*, 316*b* would engage a guide or a bottom track.

It should be noted that the jamb 120, 220, 320 could be modified to create a finished doorway that does not accommodate a door. In this case, elements such as hinge mortises 146, lock mortises 148, and tracks 256, 356 would not be needed.

It should also be noted that the jamb 120, 220, 320 may be modified to include a bottom or lower cross member 160, 260 that is shown in phantom in FIGS. 1 and 6. In this case, the second end 29 of first side member 121, 221 is attached to the first end 28 of lower cross member 160, 260 and the second end 29 of second side member 122, 222, 322 is attached to the second end 29 of lower cross member 160, 260 to form a rectangle.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. A multi-purpose adjustable doorjamb assembly for installing a door in a rough cut wall opening, said assembly comprising (a) at least three elongate members including a first side member, a second side member, and a cross member, each elongate member having an inside longitudinal face and an outside longitudinal face, a front longitudinal edge and a back longitudinal edge, and a first end and a second end, (b) a longitudinal notch in each of said faces, and (c) at least three door stops, each door stop having a cap and a protrusion mating with said longitudinal notch in said faces, wherein each of said first and second side members is symmetrical about a longitudinal plane bisecting said inside and outside faces, and said first end of said first side member is attached to said first end of said cross member and said first end of said second side member is attached to said second end of said cross member to form at least three sides of a rectangle form having an inside, and said inside face of each of said elongate members faces inwardly toward said inside of said rectangle form, and wherein said protrusion of each said door stop is inserted into said longitudinal notch of said inside face of one of said elongate members so that each of said door stops is mated to one of said elongate members.

2. The assembly of claim 1 wherein each said longitudinal notch extends substantially from said first end to said second end of each of said elongate members.

3. The assembly of claim 1, including a swinging door hingedly attached to said first side member.

4. The assembly of claim 3 wherein said first side member has at least one hinge mortise on said inside face adjacent said front longitudinal edge and at least one hinge mortise on the outside face adjacent said front longitudinal edge.

5. The assembly of claim 3 wherein said first side member has at least one lock mortise on said inside face adjacent said front longitudinal edge and at least one lock mortise on the outside face adjacent said front longitudinal edge.

6. The assembly of claim 1, including (a) a bi-fold door having a first door section that is hingedly attached to a second door section, said first door section having a top pivot on a top door surface of said first door section and a bottom pivot on a bottom door surface of said first door section, and said second door section having a glide on a top door surface of said second door section, and (b) a track in at least one of said faces of said cross member, wherein said top pivot engages said cross member and said glide slidably engages said track.

7. The assembly of claim 6 wherein said notches in said elongate members are closer to said back longitudinal edge than to said front longitudinal edge.

8. The assembly of claim 1, including (a) at least one sliding door having a top door surface, and (b) a track in at least one of said faces of said cross member, wherein said at least one sliding door slidably engages said track.

9. The assembly of claim 8, including (a) a first sliding door and a second sliding door, and (b) said track has a first longitudinal track section adjacent to a second longitudinal track section, wherein said first sliding door slidably engages said first longitudinal track section and said second sliding door slidably engages said second longitudinal track section.

10. The assembly of claim 8 wherein said top door surface includes at least one glide.

11. The assembly of claim 1, further comprising a substantially flat surface on said first end of said elongate members and a substantially flat surface on said second end of said elongate members, wherein said inside longitudinal face of said cross member mates with said first end of said first side member and said inside longitudinal face of said cross member mates with said first end of said second side member, and wherein a fastener extends from said outside face adjacent said first end of said cross member through said first end of said first side member, and wherein a fastener extends from said outside face adjacent said second end of said cross member through said first end of said second side member.

12. The assembly of claim 1, including an upwardly extending central protrusion in each of the first ends of said first and second side members, said central protrusion having an inside protrusion face and an outside protrusion face, wherein said first end of said cross member mates with said inside protrusion face of said first side member and said second end of said cross member mates with said inside protrusion face of said second side member, and wherein a fastener extends from said outside protrusion face of said first side member through said first end of said cross member, and wherein a fastener extends from said outside protrusion face of said second side member through said second end of said cross member.

13. The assembly of claim 1, including four elongate members including said first side member, said second side member, said cross member, and a lower cross member, wherein, said second end of said first side member is attached to said first end of said lower cross member, and said second end of said second side member is attached to said bottom of said lower cross member, thereby forming a rectangle.

14. The assembly of claim 1, including (a) a longitudinal trim notch in at least one of said longitudinal edges of each elongate member, and (b) at least three L-shaped trim members, each trim member having a mating leg adjustably mating with said trim notch, and each trim member having a decorative leg, whereby each decorative leg provides an attractive finish to said assembly when said mating leg mates with said trim notch.

15. The assembly of claim 1, including (a) a longitudinal trim notch in said front and back longitudinal edges of each elongate member, and (b) at least six L-shaped trim members, each trim member having a mating leg adjustably mating with said trim notch, and each trim member having a decorative leg, wherein three of said mating legs adjustably mate with said trim notches on the front longitudinal edges of said elongate members and three of said mating legs mate with said trim notches on the back longitudinal edges of said elongate members.

16. An adjustable bi-fold door assembly comprising (a) a bi-fold door having a first door section that is hingedly attached to a second door section, said first door section having a top pivot on a top door surface of said first door section and a bottom pivot on a bottom door surface of said first door section, and said second door section having a glide on a top door surface of said second door section, (b) at least three elongate members including a first side member, a second side member, and a cross member, each elongate member having an inside longitudinal face and an outside longitudinal face, a front longitudinal edge and a back longitudinal edge, and a first end and a second end, (c) a longitudinal notch in each of said faces, each of said first and second side members is symmetrical about a longitudinal plane bisecting said inside and outside faces, (d) a first track in at least one of said faces of said cross member, wherein said top pivot pivotably engages said cross member and said glide slidably engages said first track, and (e) at least three door stops, each door stop having a cap and a protrusion mating with said longitudinal notch in said faces, wherein said first end of said first side member is attached to said first end of said cross member and said first end of said second side member is attached to said second end of said cross member to form at least three sides of a rectangle form having an inside, and said inside face of each of said elongate members faces inwardly towards said inside of said rectangle form, and wherein said protrusion of each said door stop is inserted into said longitudinal notch of said inside face of one of said elongate members so that each of said door stops is mated to one of said elongate members.

17. The assembly of claim 16, including a second track in said outside face of at least one of said side members.

18. An adjustable sliding door assembly comprising (a) at least one sliding door having a top door surface, (b) at least three elongate members including a first side member, a second side member, and a cross member, each elongate member having an inside longitudinal face and an outside longitudinal face, a front longitudinal edge and a back longitudinal edge, and a first end and a second end, (c) a longitudinal notch in each said face, wherein each of said first and second side members is symmetrical about a longitudinal plane bisecting said inside and outside faces, (d) at least one track in at least one of said faces of said cross member, wherein said top door surface of said at least one sliding door slidably engages said at least one track, and (e) at least three door stops, each door stop having a cap and a protrusion mating with said longitudinal notch in said faces, wherein said first end of said first side member is attached to said first end of said cross member and said first end of said second side member is attached to said second end of said cross member to form at least three sides of a rectangle form having an inside, and said inside face of each of said elongate members faces inwardly towards said inside of said rectangle form, and wherein said protrusion of each said door stop is inserted into said longitudinal notch of said inside face of one of said elongate members so that each of said door stops is mated to one of said elongate members.

19. The assembly of claim 18, including a track in said outside face of at least one of said side members.

20. The assembly of claim 18, including (a) a first sliding door and a second sliding door, and (b) a first longitudinal track section adjacent a second longitudinal track section, wherein said first sliding door slidably engages said first longitudinal track section and said second sliding door slidably engages said second longitudinal track section.

21. The assembly of claim 18 wherein said top door surface includes at least one glide.

22. A multi-purpose adjustable doorjamb assembly for installing a door in a rough cut wall opening, said assembly comprising (a) at least three single-piece elongate members including a first side member, a second side member, and a cross member, each elongate member having an inside longitudinal face and an outside longitudinal face, a front longitudinal edge and a back longitudinal edge, and a first end and a second end, (b) a longitudinal notch in each of said faces, (c) each of said first and second side members is symmetrical about a longitudinal plane bisecting said inside and outside faces, (d) said first end of said first side member is attached to said first end of said cross member and said first end of said second side member is attached to said second end of said cross member to form at least three sides of a rectangle form having an inside, and said inside face of each of said elongate members faces inwardly toward said inside of said rectangle form, and (e) at least three door stops, each door stop having a cap and a protrusion mating with said longitudinal notch in said inside faces.

* * * * *